US006336708B1

(12) United States Patent
West et al.

(10) Patent No.: US 6,336,708 B1
(45) **Date of Patent: *Jan. 8, 2002**

(54) INK JET NOZZLE

(75) Inventors: David B. West, Cambridge; Scott Barraclough, Gloucester, both of MA (US)

(73) Assignee: Iris Graphics, Inc., Bedford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/290,527

(22) Filed: Apr. 12, 1999

Related U.S. Application Data

(63) Continuation of application No. 08/370,642, filed on Jan. 10, 1995, now abandoned, which is a continuation-in-part of application No. 08/116,980, filed on Sep. 10, 1993, now Pat. No. 5,407,136, which is a continuation-in-part of application No. 07/947,278, filed on Sep. 18, 1992, now abandoned.

(51) Int. Cl.[7] ..... B41J 2/135; B41J 2/14

(52) U.S. Cl. ..... 347/47; 347/74; 239/589; 239/592

(58) Field of Search ..... 347/47, 73, 74; 239/589, 592

(56) References Cited

U.S. PATENT DOCUMENTS

| | | | | |
|---|---|---|---|---|
| 907,025 | A | 12/1908 | Ford | |
| 1,730,099 | A | 10/1929 | Tribbert | |
| 1,846,500 | A | 2/1932 | Thompson | 222/385 |
| 3,393,988 | A | 7/1968 | Blumenthal | 65/61 |
| 3,620,457 | A | 11/1971 | Pearson | 239/589 |
| 3,717,875 | A * | 2/1973 | Arciprete et al. | 347/73 |
| 3,955,953 | A | 5/1976 | Hauser | 65/18 |
| 3,985,535 | A | 10/1976 | Bennett et al. | 65/61 |
| 3,986,636 | A | 10/1976 | Hoppmann et al. | 221/7 |

(List continued on next page.)

FOREIGN PATENT DOCUMENTS

| | | |
|---|---|---|
| EP | 0097413 | 1/1984 |
| WO | WO 9014956 | 12/1990 |

OTHER PUBLICATIONS

*Anil K. Jain, "A Fast Two Dimensional Median Filtering", Digital Image Processing, Published by Prentice Hall**.*

*"Technique for Producing Capillaries with Reproducible Orifice Diameters for Uniform Droplet Generation", Paul J. Galley, et al. 1369 Applied Spectroscopy, 46 (1992) Oct., No. 10, Frederick, MD, USA**.*

(List continued on next page.)

*Primary Examiner*—John Barlow
*Assistant Examiner*—Blaise Mouttet
(74) *Attorney, Agent, or Firm*—Weingarten, Schurgin, Gagnebin & Hayes LLP

(57) ABSTRACT

A nozzle for an ink-jet printer is provided. The nozzle is manufactured from a heat-softenable tube and has a gradually converging inner diameter leading to an orifice less than 30 microns in diameter and an outer nozzle diameter proximate the orifice at least as great as the outer diameter at other points along the tube. The nozzle is produced by heating a short segment of a heat-softenable tube while rotating it, until said segment is sufficiently softened to cause the inner diameter to converge at an angle between 5 and 25 degrees with respect to the axis of symmetry of the tube, and until the inner diameter is equal to or less than a selected orifice diameter. The gradual taper is achieved solely as a result of heat-activated surface forces inherent in the tube material and without external drawing or pulling of the tube. Further the gradual taper facilitates achieving a desired orifice dimension during removal of a portion of the tube having an inner diameter less than the selected orifice diameter. The extremely small orifice size enables an ink-jet printer to deposit droplets of ink sufficiently small to make photographic-quality gray scale and color images. Such a nozzle can also advantageously be used for biological, medical and pharmaceutical apparatuses and devices.

16 Claims, 2 Drawing Sheets

U.S. PATENT DOCUMENTS

| | | | | | |
|---|---|---|---|---|---|
| 4,111,677 | A | | 9/1978 | Andrews | 65/271 |
| 4,185,706 | A | | 1/1980 | Baker, III et al. | 175/340 |
| 4,278,983 | A | * | 7/1981 | Halasz | 347/47 |
| 4,343,013 | A | * | 8/1982 | Bader et al. | 347/47 |
| 4,372,773 | A | | 2/1983 | Halasz | 65/108 |
| 4,418,356 | A | | 11/1983 | Recce | 347/40 |
| 4,483,008 | A | * | 11/1984 | Varrasso | 373/27 |
| 4,675,043 | A | * | 6/1987 | Conta et al. | 65/160 |
| 4,723,129 | A | * | 2/1988 | Endo et al. | 347/56 |
| 4,786,303 | A | | 11/1988 | Padalino | 65/439 |
| 4,813,611 | A | | 3/1989 | Fontana | 239/589 |
| 4,834,637 | A | | 5/1989 | Conta et al. | 425/110 |
| 4,852,454 | A | * | 8/1989 | Batchelder | 89/1.11 |
| 4,942,296 | A | | 7/1990 | Jones | 250/288 |
| 5,407,136 | A | * | 4/1995 | West et al. | 239/589 |

OTHER PUBLICATIONS

*"Fundamentals of Digital Image Processing", Anil K. Jain, Prentice Hall Information and System Sciences Series, pp. 233–255**.*

*A Survey of the Hough Transform, J. Illingworth, et al. Department of Electronics and Electrical Engineering, University of Surrey, Aug. 10, 1987**.*

*"A Computational Approach to Edge Detection", John Canny, IEEE Transactions of Pattern Analysis and Machine Intelligence, vol. PAMI–8, No. 6, Nov. 1986, pp. 679–697**.*

* cited by examiner

FIG. 4
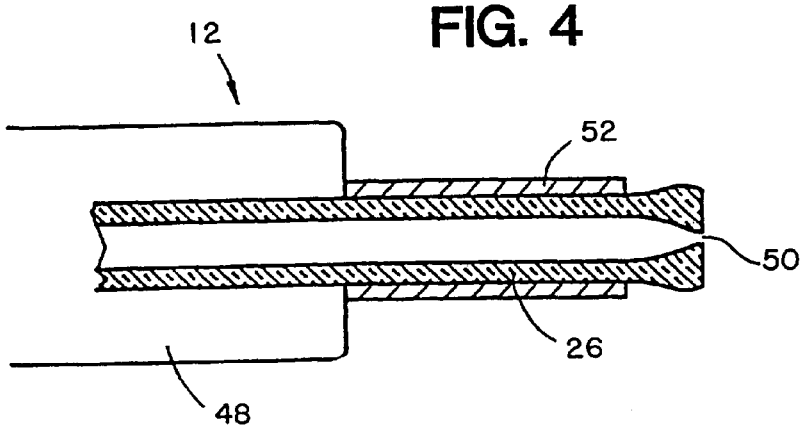
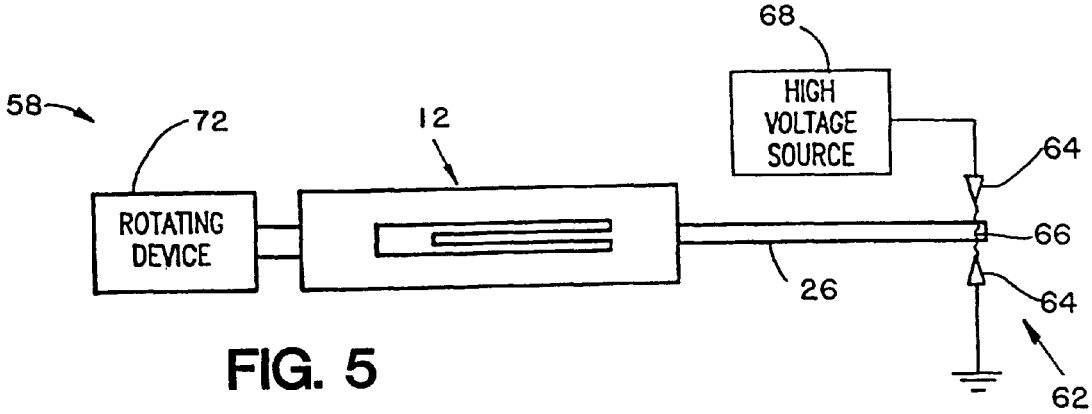
FIG. 5
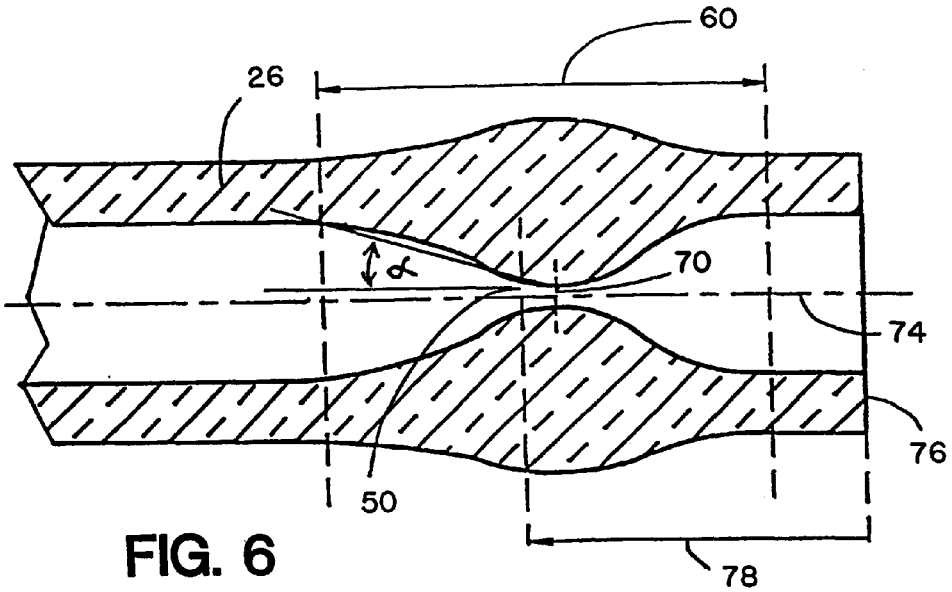
FIG. 6

INK JET NOZZLE

RELATED APPLICATIONS

This application is a continuation of prior application Ser. No. 08/370,642, filed Jan. 10, 1995 now abandoned, which is a continuation-in-part of application Ser. No. 08/116,980 filed Sep. 10, 1993, now U.S. Pat. 5,407,136, which is a continuation-in-part of application Ser. No. 07/947,278 filed Sep. 18, 1992, now abandoned.

FIELD OF THE INVENTION

The present invention relates to fluid-dispensing nozzles generally, and to micro-scale ink-jet nozzles used in high resolution color and gray scale printing in particular.

BACKGROUND OF THE INVENTION

Ink-jet printers have rapidly gained in popularity as a means for generating a high quality color and gray scale images from computer sources. Because of the large drop size produced by most ink-jet printers, the color and gray scale images they produce are limited to less than 10 color tone or gray scale levels per atomic picture element (pixel). Although this is adequate for certain applications such as business graphics and color highlighting, it is unquestionably inadequate for making accurate representations of real world colors and does not approach a true photographic appearance.

An ink-jet device makes color images by physically mixing ink on the print medium to obtain a desired color. Inks for a color ink-jet printer are generally selected from one or more of black, magenta, cyan, and yellow colors. The inks generally contain less than 25% colorant and other additives in a water-base vehicle for jetting. Presently known devices include those operating at a resolution of 300 pixels per inch (ppi), wherein each of the jetted drops are sized to fill a $0.08\times0.08$ mm$^2$ pixel for printing on standard imaging papers and media, and also those operating at a resolution of 150 ppi, wherein each of the jetted drops are sized to fill a $0.17\times0.17$ mm$^2$ pixel for printing on highly ink-absorbing medias such as cotton textiles or unsized papers or for printing large images to be viewed from distances of more than about 5 feet such as signage. Because of the above-described large size drops, the said devices are limited in the gradation of color saturation and shade, and thus in the realism that they can provide as a result of this limitation. However if the individual ink drops can be made smaller, the number of ink drops deposited per pixel can be increased, and it is possible to vary the number of ink drops deposited within a pixel to obtain a wide gradation of color saturations and shades, enabling photographic quality coloring.

It is known that a range of zero to thirty droplets per $0.08\times0.08$ mm$^2$ pixel per color printed on standard image media or per $0.17\times0.17$ mm$^2$ pixel per color for signage or highly ink-absorbing media enables the creation of hundreds of different color saturations and shades discernible by the human eye. Thus, it would be desirable to provide a group of nozzles capable of providing thirty or more droplets per pixel.

In addition to the appropriate control software and inks, the above described color and gray scale image production using ink-jet technology requires ink-jet nozzles capable of consistently dispensing the very small droplets of ink. Any imperfections in the ink-jet nozzle orifice can cause a dispersion or deflection of the ink-jet with disastrous consequences for the print quality, especially when the jetting pattern of four or more nozzles must be coordinated.

In order to obtain photographic quality color and gray scale images using an ink-jet device, a nozzle with an orifice approximately 15 microns or less in diameter is required for standard imaging media, or 30 microns or less for signage or highly ink-absorbing media such as cotton textiles or unsized papers. Whatever the selected diameter of the nozzle for a given ink-jet printer product, it is necessary that the manufactured nozzle diameters vary by no more than ±0.6 microns so that the printed color saturations and shades do not vary perceptibly from printer to printer. It is known in the art to fabricate ink-jet nozzles from glass tubes, but because of the difficulty in manufacturing a nozzle having such a small orifice size from a glass tube, it is desirable to provide a method of consistently providing nozzles of the precise dimensions needed.

One prior art ink nozzle is illustrated in U.S. Pat. No. 22 3,393,988 to Blumenthal, wherein a nozzle having an orifice 0.003 to 0.0004 inches is formed by heating the lower end of a vertically oriented, low melting point, glass tube with a flame burner until it melts into a tear-drop shape under the influence of gravity, thereby forming a converging inner passage that is abruptly tapered (60 to 90° average included angle with respect to the central axis of the passage). Glass at the end of the tube is then removed to establish an abruptly converging passageway with a central orifice which is subsequently flame polished to provide smooth surfaces.

It should be noted that Blumenthal's requirement that the tube be oriented vertically, due to the technique's reliance on the force of gravity, is a severe manufacturing limitation. It should also be noted that Blumenthal specifically teaches away from a gently tapered converging portion leading to the orifice. Were such an abruptly tapered end as shown in Blumenthal be ground in an attempt to provide an orifice five times smaller, with the precision, perfection and symmetry required for photographic quality color or gray scale printing, the results would be uncertain. Furthermore, even if a 30 micron or less diameter orifice were to be obtained, the flame polishing step of Blumenthal would exacerbate grinding-induced flaws in the orifice edge and produce an unacceptable variation in the diameter of the orifice with respect to the requirements for the above described printing applications. Even further, such an abrupt taper leading to the orifice results in an additional burden on the grinding process in that a more stringent criteria for orifice perfection and symmetry is necessary to assure a steady and well-directed ink-jet stream.

The drawing or pulling method of making a converging passage, specifically rejected by Blumenthal, is described in U.S. Pat. Nos. 3,986,636 and 4,111,677. As Blumenthal indicates, drawing a glass tube causes a reduction in passage diameter gradually over such an extended distance that it causes fluid flow problems. In order to draw a glass tube, a relatively large portion of the tube must be made molten, and glass in its molten state is very hard to dimension with accuracy.

Additionally, pulling a heated glass tube to cause narrowing of a central passage causes a concomitant reduction in wall thickness. The resulting drawn portion of the glass tube is therefore extremely fragile even at the diameters taught by Blumenthal, and is extraordinarily so in a tube one tenth the size. Reinforcement of the fragile drawn tube is demonstrated in a fluid-dispensing device, the 9103557E173E manufactured by Siemens-Elema AB of Sweden, which provides a metal sheath over the tube, except in the area of the orifice where the tube is uncovered.

Therefore, in addition to the other above-recited features lacking in the prior art, it would be desirable to provide a nozzle having an inner wall leading to an orifice with a less extensive taper than a drawn tube, yet more taper than the Blumenthal nozzle, and capable of being manufactured with a precision orifice in the thirty micron or less range. It would further be desirable to form such a nozzle without weakening it so that it is unmanageably fragile or so that it requires reinforcement. It would further be desirable to provide a nozzle which can be formed in any position from the vertical to the horizontal.

SUMMARY OF THE INVENTION

In surmounting the foregoing disadvantages, the present invention provides a fluid-dispensing nozzle having an inner passage that tapers to an orifice approximately thirty microns or less in diameter, making possible the creation of photographic-quality color and gray scale images using an ink-jet printer. The nozzle provides a perfectly symmetrical fluid dispensing inner passage having a gentle taper formed without pulling or drawing the glass tube, and can be fabricated in any orientation from the horizontal to the vertical. The inner passage provides a taper having an angular change with respect to the axis of symmetry of the nozzle sufficient to minimize fluid flow problems encountered in drawn tubes without being an abrupt taper, while the outer diameter of the nozzle in the area of the orifice is at least as large as along the remainder of the nozzle's length. The nozzle is fabricated so that exceptional accuracy is possible during an orifice dimensioning step of fabrication. Furthermore, the nozzle is sufficiently robust to withstand handling an incidental contact without breaking.

In accordance with the invention, a nozzle for an ink-jet printer is provided having a gradually converging inner diameter leading to an orifice less than 15 microns in diameter for standard imaging media or less than 30 microns in diameter for highly ink absorbing media, and having an outer nozzle diameter proximate the orifice at least as great as the outer diameter at other points along the nozzle.

The nozzle is produced by heating a tube while rotating it, until a portion of the tube is sufficiently softened to cause the inner diameter to converge at an angle between 5 and 25 degrees with respect to the axis of symmetry of the tube, and until the inner diameter is less than a selected orifice diameter. A length of tube is then removed having an inner diameter less than or equal to the selected orifice diameter resulting in an orifice at an end of said heated tube.

The ink-jet nozzle of the invention is central to a printing process, wherein a printhead having a plurality of nozzles supplied with ink is responsive to a computer system capable of generating color raster image data. In accordance with the color raster image data, the printhead deposits ink droplets from one or more of the nozzles in the pixels required to form a two-dimensional image. The nozzles are supplied with black ink for gray scale images and differently colored inks for color images. Such a fluid-dispensing nozzle can be used advantageously for biological and medical devices and apparatuses, such as cell sorting flow cytometers and reaction creating and controlling instruments, and pharmaceutical devices and apparatuses, such as drug or pill manufacturing instruments.

BRIEF DESCRIPTION OF THE DRAWINGS

A more complete understanding of the present invention and attendant advantages and features thereof will be more readily understood by reference to the following detailed description when considered in conjunction with the accompanying drawings wherein:

FIG. 4 is an enlarged cross-sectional view of the nozzle of FIG. 2;

FIG. 5 is a partially schematic, partially block diagram illustration of an apparatus useful in producing the nozzle of FIG. 4; and FIG. 6 is a sectional illustration of a glass tube after operation of the apparatus illustrated in FIG. 5.

DETAILED DESCRIPTION OF A PREFERRED EMBODIMENT

Figure 1:
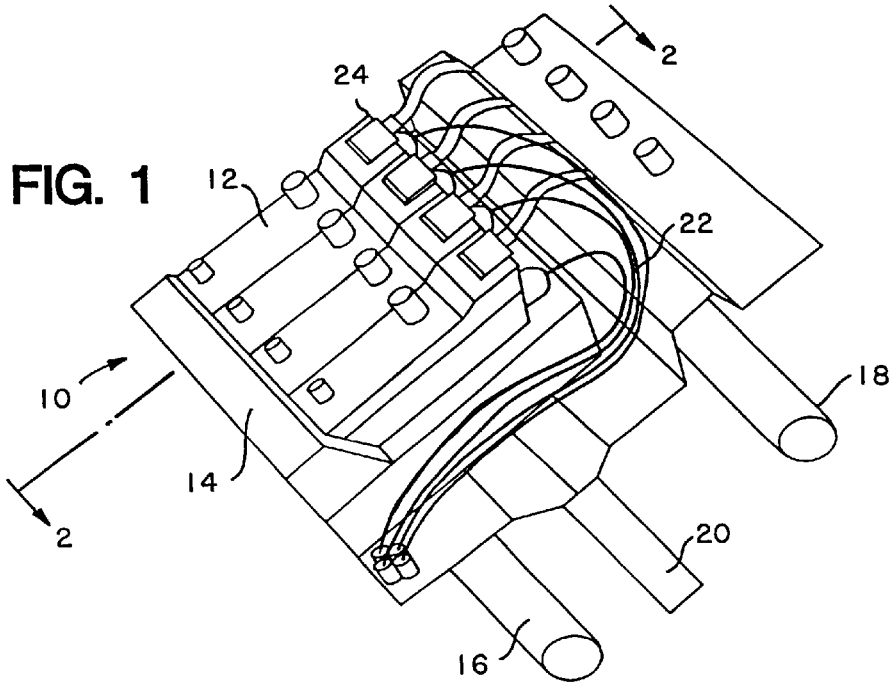
FIG. 1 is a perspective view of a printhead for a color printer having four ink nozzle assemblies.

FIG. 1 illustrates a printhead 10 for an ink-jet printer capable of gray scale and color printing, the printhead 10 including four ink nozzle assemblies 12 and a deflection assembly 14. The printhead 10 is movable along first and second guide bars 16 and 18, respectively, in response to software controlled movement of a guide belt 20. Each of the ink nozzle assemblies 12 is provided with an ink line 22 connected to an ink supply (not shown) containing a water-based ink. In this exemplary embodiment, the printhead 10 dispenses four different colors of ink cyan, magenta, yellow, and black. A single piston pump (not shown) is associated with each nozzle assembly 12 and provides a steady, calibrated flow of the selected ink throughout the printhead. Each nozzle assembly 12 is provided electrical power and control signals through a suitable electrical connector 24.

Figure 2:
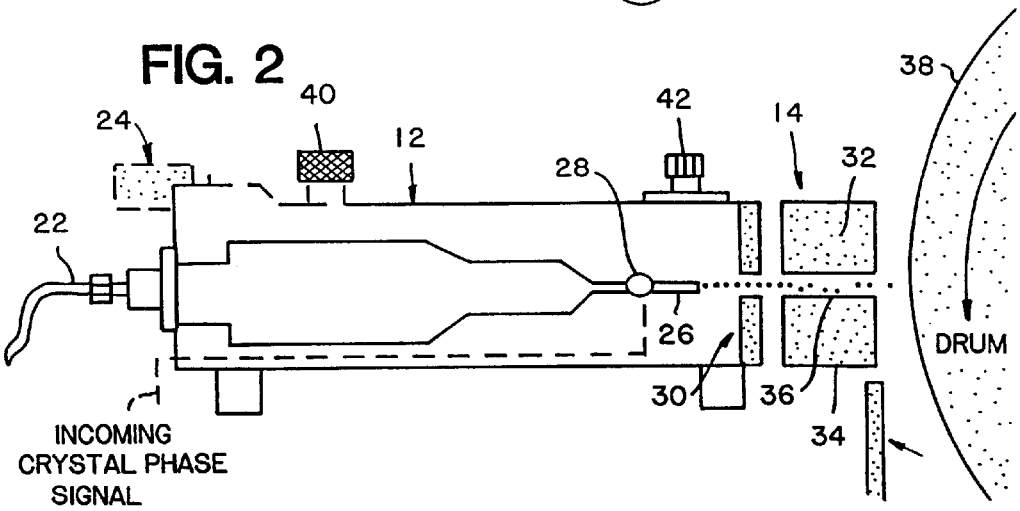
FIG. 2 is a cross-sectional view of one of the ink nozzle assemblies, taken along line 2—2 of FIG. 1.

Referring to FIG. 2, a portion of the printhead 10 is shown in cross-section to illustrate further details of a single nozzle assembly 12 and a portion of the deflection assembly 14. Ink under high pressure, typically in the range from 50 to 1000 PSI, is forced thorough a glass capillary tube 26 that has an orifice approximately fifteen microns or less in diameter. In an alternative embodiment described below, said glass capillary tube has an orifice of thirty microns or less and is otherwise similar. A continuous stream of ink exits at a speed of about 50 meters per second and then spontaneously breaks up into a stream of discrete droplets. To ensure proper droplet formation, the glass capillary 26 is mechanically stimulated by a piezo-electric crystal 28. By applying a signal typically of one MHz to the crystal 28, typically one million equally sized droplets are formed every second.

During droplet formation, the ink stream is proximate an electrode 30 which is responsive to a computer system able to generate color raster image data, and the ink droplets formed are charged or left neutral depending on the image data. For example, application of positive voltage between the electrode 30 and the ink stream causes the ink droplets to be negatively charged.

Subsequent to charging, the droplets pass into the deflection assembly 14, which includes a chargeable upper and lower deflector 32 and 34 respectively, which when appropriately charged deflects charged drops, causing them to strike a knife edge 36, whereupon the droplets are directed into a waste ink disposal system (not shown). Only neutral droplets reach the print media affixed to a rotating drum 38. By switching the signal voltage to the electrode 30 on and off at a maximum frequency equal to the droplet formation frequency, each droplet can be individually controlled to either be caught below the knife edge or deposited on the print media. It is important that every droplet be either fully charged or uncharged. Partly charged drops will be incorrectly deflected and misplaced on the print media, which will degrade print quality. Synchronization of the droplet charging with droplet formation alleviates this problem. Adjustment knobs 40 and 42 are provided for adjusting the knife edge and horizontal nozzle aim, respectively, by a conventional adjusting mechanism.

Figure 3:
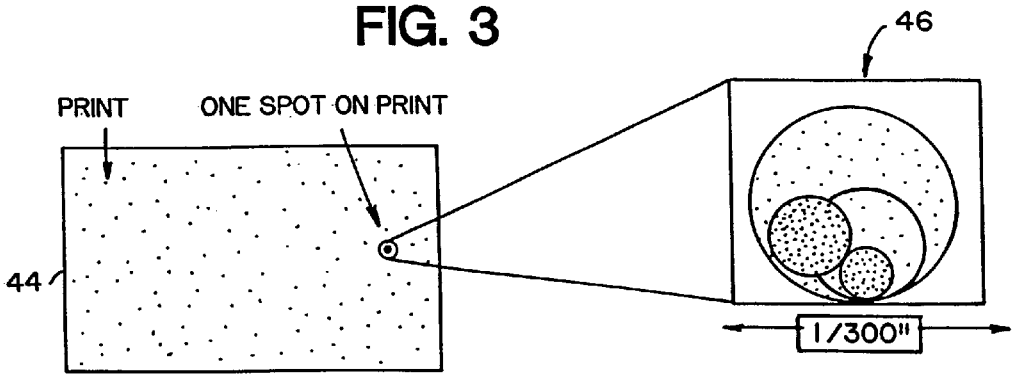
FIG. 3 illustrates formation of variably sized dots and their placement within a pixel using the nozzle illustrated in FIG. 2.

While the drum 38 is rotated, a stepping motor slowly moves the printhead 10, via the belt 20 axially with respect to the drum 38. By monitoring the drum and printhead position, each pixel along a line can be addressed. In the illustrated embodiment, each pixel has a size of 0.08×0.08 $mm^2$ which gives 300 pixels per inch. In this embodiment, the 15 micron or less diameter of the orifice of the capillary tube 26 enables production of droplets that are so small that they do not cover the entire area of a pixel. However, by increasing the number of droplets deposited in a given pixel, the dot size can be increased. Because each droplet is individually controllable, the number of droplets deposited in a single pixel can be varied from zero to more than thirty. Accordingly, a corresponding number of discrete saturation steps, true halftones, are obtainable in each pixel for each color. Referring now to FIG. 3, a printed piece of paper 44 is shown with one 1/300" pixel 46 illustrated in greater detail to show exemplary size and placement control of the droplets. This control permits a variety of printing techniques to accommodate different requirements. For example, dot-on-dot placement results in images with sharp edges and minimal image patterning. A second technique, minimal dot-on-dot overprinting between colors, reduces the degree of rainbowing and striation in prints, an effect similar to using different screen angles in conventional printing.

Although the exemplary printhead 10 is configured for 30 ppi resolution, the ability to alter each pixel, thanks to the small droplet size, enables the resolution to appear to be 1600–1800 dots per inch.

A critical component of the printhead in this embodiment which enables it to produce the small droplets is the capillary tube 26 which has an orifice of 15 or less microns. In an alternative embodiment, preferred for printing large images to be viewed from a distance of more than five feet or for printing highly ink-absorbent media such as cotton textiles or unsized papers, the capillary tube (not shown) has an orifice of 30 or less microns. The printhead in this alternative embodiment is otherwise identical. In this alternative embodiment, the pixel size is 0.17×0.17 $mm^2$ which gives 150 ppi and has an apparent resolution of 750–900 dots per inch. In all other ways, this alternative embodiment is essentially similar to the above described embodiment.

FIG. 4 is a cross-sectional view of a portion of a nozzle assembly 12 including a housing 48 and a capillary tube 26 having an orifice 50 at one end. In an exemplary embodiment of the present invention, including herein both the case of a tube with a 15 or less micron orifice and the case of a tube with a 30 or less micron orifice, the capillary tube 26 is comprised of thick-walled glass tubing, such as Flexible Fused Silica Capillary Tubing, TSP100530 manufactured by Polymicro Technologies Inc., Phoenix, Ariz., typically used for gas chromatography. Fused silica has a melting temperature of approximately 1,600° C. and is much less fragile than ordinary glass.

The above-described capillary tube 26 has generally a 500 micron outer diameter and a 100 micron inner diameter which is precisely controlled and concentric. The thick walls provide rigidity and strength to the tubing. Furthermore, the product manufactured by Polymicro Technologies Inc. is covered on the outside by a thin layer of plastic 52 which protects the tube, although this protective layer is not necessary.

From the illustration, it is notable that the orifice end of the tube 26 neither necks down nor is thinner walled than the remainder of the tube as would be the case with a drawn tube.

Typically, the outer diameter of the tube 26 of the invention, in the vicinity of the orifice 50, is 2.5% –9% larger than the outer diameter of the remainder of the tube. In this embodiment, the plastic layer 52 is removed in the area of the orifice 50.

Thick-walled tube material is advantageous because it provides rigidity during the manufacturing process. It also is advantageous to use thick-walled tube material having an inner diameter no more than about ten times larger than the diameter of the desired orifice 50, thereby minimizing the extent of distortion of the inner diameter which occurs during the forming process.

The orifice 50, produced in the tube 26 in a manner described in more detail hereinbelow with respect to FIG. 6, typically has a diameter approximately ten times smaller than the inner diameter of the remainder of the tubing, although any extent of reduction is possible. For applications having paper as the print medium (or other standard imaging media), the diameter of the orifice 50 is approximately 10 microns, and may be typically 9.70 ±0.35 microns. For printing on textiles or other highly absorbent materials, or for printing large-format images intended to be viewed from distances of greater than about 5 feet, the diameter of the orifice 50 is approximately 20 microns.

Reference is now made to FIGS. 5 and 6. FIG. 5 illustrates an apparatus 58 for creating a "pre-orifice" 60, or preliminary version of the orifice 50 as shown in FIG. 6. The apparatus 58 typically comprises an arc forming unit 62, such as the PFS300-26 Fusion Fiber Splicer manufactured by Power Technology Inc., Little Rock, Ark. The arc forming unit 62 comprises two electrodes 64, which in the preferred embodiment are placed near to, but not at, the end of tube 26 for creating an electric arc 66 with which to soften the tube 26. One of the electrodes 64 is grounded and the other electrode 64 is in electrical communication with a high voltage source 68. Typically, the amount of heat generated by the arc forming unit 62 and the length of time the heat is provided to the tube 26 are controllable by limiting the electrical current of the arc and by operating the arc forming unit 62 in a pulsed manner such as by pulsing the high voltage source 68. Lasers, masked or confined flames or plasmas or other sources of controllable, concentrated heat can alternatively be utilized as long as they are able to achieve temperatures capable of softening the fused silica tube 26 which has a melting temperature of approximately 1,600° C., and can heat the selected section of tubing rapidly enough such that the heating remains proximate to said section. An ordinary gas flame burner, such as a Bunsen burner, is incapable of performing this task for a glass tube in part because the heating flame is not masked or confined.

The electric arc 66 generates enough heat to soften the tube 26, or alternatively in the case of said fused silica or glass tube, reduce the viscosity of the tube 26, in the area of the pre-orifice 60, and the heat is greatest at the central area of the pre-orifice 60. Surface tension forces on the softened or reduced viscosity material cause the area to assume a generally spherical shape (as seen in FIG. 6), thereby locally reducing the inner diameter of the tube 26 and generally increasing its outer diameter.

As can be seen from FIG. 6, in the area of the pre-orifice 60, the inner diameter has an hourglass shape, tapering from the inner diameter of the remainder of the tube 26 to the inner diameter of the pre-orifice 60 at an angle of convergence "$\alpha$" which is between 5 and 25 degrees with respect to the central axis of the tube 26, without completely closing off the pre-orifice. Typically, the angle of convergence. $\alpha$ is approximately one-half the average included angle defined by Blumenthal, as described hereinabove, and is measured as the angle of intersection between the central axis of symmetry 74 at the point of the below described vena contracta and a line 71 constructed from a point on said tube inner diameter at the edge of the visibly affected pre-orifice region 60 on the housing 48 side of said tube.

The inner diameter of the tube 26 then increases in diameter until reaching the end of said tube. The narrowest point in the interior of the tube 26, labeled 70, is known as the vena contracta. The precision of this confined and controlled heating method in combination with the material in this preferred embodiment is such that the diameter of the vena contracts 70 can be controlled to an accuracy of ±0.1 microns.

Because arc 66 provides very concentrated heat, a relatively narrow segment of the tubing is softened or made somewhat viscous. The degree and length of time of heating are generally tightly controlled, and the tube rotated during fabrication (as described herein below), so that the glass of the heated segment does not run, drip or otherwise exhibit the influence of gravity, nor is it dependent thereon for assuming the required shape. Therefore, the heating of the tube 26 can be performed horizontally or at any other non-vertical position and no external drawing or axial pulling is applied. Accordingly, the increase in the outer diameter is larger than occurs in the manufacturing of prior art nozzles, all of which utilize drawing forces or are otherwise influenced by gravity or other external forces, providing the tube 26 of the present invention with a robust tip.

The arc 66 is operated until the diameter of the vena contracta 70, located, in one embodiment of the invention, close to but not at the end of the glass tube 26, is at or below a predetermined value, typically equal to or smaller than (but typically not closed) the desired diameter of the orifice 50. Orifice 50, with a diameter equal to or larger than the vena contracta 70, is at or on the housing 48 side of the vena contracta. Heating other than at the end of the tube is beneficial in that the end of the tube does require any preparation. Additionally, heating at other than at the end permits the material to be ground back so as to ensure that the orifice 50 is not angled.

To ensure that the hourglass shape of the inner diameter is concentric and that the pre-orifice area is evenly heated, the tube 26 is fixed in housing 48 and rotated about its axis 74 during heating typically via a rotation device 72, such as a motor or a rotary joint. This also ensures that the axis of symmetry of the orifice 60 is substantially collinear with the axis of symmetry 74 of the tube 26. Rotation is possible over a broad range of rates, such as 50 to 1500 RPM.

After heating, the material between the end 76 of tube 26 and the orifice 50 is removed, typically via grinding but any other suitable method can be used. The removal is indicated in FIG. 6 by an arrow 78. A significant advantage of the present invention is evident during this critical dimensioning step, wherein the gradual restriction of the vena contracta 70 allows a more controlled grinding or material removal to be performed. In an exemplary embodiment, the diameter of the vena contracta 70 is ground back from 9.5 microns to 9.7 microns, an orifice diameter required to make the extremely high quality images described hereinabove. Were the taper to be abrupt, such as defined by Blumenthal hereinabove described, the removal of sufficient material to cause such a change in diameter would be almost impossibly difficult to achieve using present manufacturing methods, with predictable precision.

It will be appreciated by one normally skilled in the art that after heating, the outer diameter of tube 26 proximate the orifice is reduced somewhat by material removal Typically grinding is employed, but any other suitable material removal method may be used.

In an alternative embodiment of the present invention, arc 66 is placed at, close to, or slightly away from end 76 of tube 26. The vena contracta 70 formed thereby can be directly used as the orifice 50, without having to remove any material. An advantage of this embodiment is that the diameter of the vena contracta 70 can be controlled very precisely and repeatably to less than ±0.1 micron as described hereinabove.

It will be appreciated by persons skilled in the art that the present invention is not limited to what has been particularly shown and described hereinabove. A variety of modifications and variations are possible in light of the above teachings without departing from the scope and spirit of the invention, which is limited only by the following claims.

What is claimed is:

1. A non-metallic nozzle for a fluid dispensing device comprising:

a heat softenable non-metallic tube defining an ink passageway having an axis of symmetry, said tube comprising:

an annular passage portion having a first predetermined outer diameter and a first predetermined inner diameter; and an annular orifice portion having a second predetermined outer diameter and a second predetermined inner diameter, said first inner diameter converging to an orifice in the orifice portion having said second inner diameter of less than or about 30 microns at an angle of convergence between 5 and 25 degrees with said axis of symmetry, wherein the second outer diameter is at least as great as the first outer diameter.

2. The nozzle of claim 1, wherein said orifice has an axis of symmetry collinear with said axis of symmetry of said tube.

3. The nozzle of claim 1, wherein said heat softenable tube comprises glass.

4. The nozzle of claim 3, wherein said glass tube comprises fused silica having a melting temperature of approximately 1,600° C.

5. The nozzle of claim 3, wherein a portion of said glass tube is covered with a layer of plastic.

6. The nozzle of claim 1, wherein said second outer diameter is 2.5% to 9% larger than said first outer diameter proximate said orifice.

7. A nozzle according to claim 1, and wherein said ink passageway is narrowest at a downstream end thereof.

8. The nozzle of claim 1, wherein said nozzle is used solely for ink-jet printers.

9. A method of producing the nozzle of claim 1, including the steps of:

providing a heat source;

rotating said tube relative to said heat source; and heating said tube to a state of reduced viscosity, causing said first inner diameter to converge to less than said second inner diameter without applying an axial force to said tube, said first inner diameter converging to said second inner diameter at an angle between 5 and 25 degrees with respect to said axis of symmetry.

10. The nozzle of claim 9, wherein said heat source is an electric arc.

11. The nozzle of claim 9, wherein a length of said tube is removed along said converging inner diameter to define said orifice having a diameter less than or about 30 microns.

12. The nozzle of claim 11, wherein said length of tube is removed by grinding.

13. An ink-jet printing process, comprising the steps of:

providing a computer system capable of generating color raster image data and print command signals;

providing a printhead responsive to said computer system, said printhead including, a plurality of nozzles, each said nozzle having, a heat softenable tube defining an ink passageway having an axis of symmetry, a first outer diameter, and a first inner diameter;

said first inner diameter converging to an orifice having a second inner diameter of less than or about 30 microns at an angle of convergence between 5 and 25 degrees with said axis of symmetry; and a second outer diameter that is larger than said first outer diameter proximate said orifice;

a plurality of piezo-electric crystals, one said piezo-electric crystal associated with each nozzle for mechanically stimulating said nozzle;

a plurality of electrodes, one said electrode associated with each said nozzle for imparting an electric charge to droplets of ink jetted from said nozzle;

a deflection assembly including a chargeable deflector for attracting and deflecting charged ink droplets;

providing ink to said plurality of nozzles; and depositing ink droplets from said printhead in accordance with said color raster image data in each of a plurality of pixels, thereby forming an image.

14. An ink-jet printing process, comprising the steps of:

A. providing a computer system capable of generating color raster image data and print command signals;

B. providing a printhead responsive to said computer system, said printhead including:

a plurality of nozzles, each nozzle having:

a heat softenable, non-metallic tube defining an ink passageway having an axis of symmetry, said tube comprising:

an annular passage portion having a first outer diameter and a first inner diameter, and an annular orifice portion having a second outer diameter and a second inner diameter;

said first inner diameter converging to an orifice in the orifice portion having said second inner diameter of less than or about 30 microns at an angle of convergence between 5 and 25 degrees with said axis of symmetry, wherein the second outer diameter is at least as great as the first outer diameter;

a plurality of piezo-electric crystals, one said piezo-electric crystal associated with each said nozzle for mechanically stimulating said nozzle;

a deflection assembly including a chargeable deflector for attracting and deflecting charged ink droplets;

C. providing ink to said plurality of nozzles; and

D. depositing ink droplets from said printhead in accordance with said color raster image data in each of a plurality of pixels, thereby forming an image.

15. An ink-jet printing process, comprising the steps of:

providing ink to a nozzle including a constriction narrowing to a cross-sectional area of less than or about 30 microns at an angle of convergence between 5 and 25 degrees;

deflecting said ink in accordance with data to provide an interrupted stream;

directing said stream toward a print medium; and scanning said stream across said print medium to provide a two dimensional ink-jet image, wherein the nozzle comprises:

a heat softenable tube defining an ink passageway having an axis of symmetry, a first outer diameter, and a first inner diameter;

said first inner diameter converging to an orifice having a second inner diameter of less than or about 30 microns at an angle of convergence between 5 and 25 degrees with said axis of symmetry; and a second outer diameter that is larger than said first outer diameter proximate said orifice.

16. A non-metallic nozzle for a fluid dispensing device comprising:

a heat softenable, non-metallic tube defining an ink passageway having an axis of symmetry, said tube comprising:

an annular passage portion having a first outer diameter and a first inner diameter, and an annular orifice portion having a second outer diameter and a second inner diameter, said first inner diameter converging to an orifice in the orifice portion having said second inner diameter of less than or about 30 microns at an angle of convergence between 5 and 25 degrees with said axis of symmetry, wherein said second outer diameter is at least 90 percent of the first outer diameter.

* * * * *

UNITED STATES PATENT AND TRADEMARK OFFICE

CERTIFICATE OF CORRECTION

PATENT NO. : 6,336,708 B1 Page 1 of 1
DATED : January 8, 2002
INVENTOR(S) : David B. West et al.

It is certified that error appears in the above-identified patent and that said Letters Patent is hereby corrected as shown below:

Column 2,
Line 18, delete "22"; and

Column 7,
Line 24, "contracts" should read -- contracta --.

Signed and Sealed this

Twenty-sixth Day of November, 2002

*Attest:*

*Attesting Officer*

JAMES E. ROGAN
*Director of the United States Patent and Trademark Office*